United States Patent [19]

Carvajal et al.

[11] Patent Number: 4,939,442

[45] Date of Patent: Jul. 3, 1990

[54] BANDGAP VOLTAGE REFERENCE AND METHOD WITH FURTHER TEMPERATURE CORRECTION

[75] Inventors: Fernando D. Carvajal, McKinney; Thomas A. Schmidt, Dallas, both of Tex.

[73] Assignee: Texas Instruments Incorporated, Dallas, Tex.

[21] Appl. No.: 330,660

[22] Filed: Mar. 30, 1989

[51] Int. Cl.[5] ..... G05F 1/567; G05F 3/30

[52] U.S. Cl. ..... 323/281; 323/314; 323/907

[58] Field of Search ..... 323/231, 313, 314, 907, 323/274, 281

[56] References Cited

U.S. PATENT DOCUMENTS

| | | | |
|---|---|---|---|
| 4,325,018 | 4/1982 | Schade | 323/313 |
| 4,525,663 | 6/1985 | Henry | 323/281 |
| 4,603,291 | 7/1986 | Nelson | 323/907 |
| 4,633,165 | 12/1986 | Pietkiewicz | 323/314 |
| 4,668,903 | 5/1987 | Elbert | 323/231 |
| 4,789,819 | 12/1988 | Nelson | 323/314 |
| 4,808,908 | 2/1989 | Lewis et al. | 323/313 |

FOREIGN PATENT DOCUMENTS

| | | |
|---|---|---|
| 34617 | 2/1986 | Japan . |
| 1283729 | 1/1987 | U.S.S.R. . |
| 2199677 | 7/1988 | United Kingdom . |

OTHER PUBLICATIONS

Martin, "Temperature Sensing and Compensating Reference Voltage Supplies," IBM Tech. Discl. Bul., vol. 7, No. 5, pp. 357-358, (10-1964).

"Session VI: Data Acquisition Circuits, A Curvature Corrected Micropower Voltage Reference", Carl R. Palmer and Robert C. Dobkin, 1981 IEEE International Solid-State Circuits Conf., pp. 58-59.

"A New Curvature-Corrected Bandgap Reference", Gerard Meijer, Peter C. Schmale and Klaas Van Zalinge, 1982 IEEE Journal of Solid-State Circuits, vol. SC-17 No. 6 Dec., 1982, pp. 1139-1143.

*Primary Examiner*—William H. Beha, Jr.

*Attorney, Agent, or Firm*—B. Peter Barndt; James T. Comfort; Melvin Sharp

[57] ABSTRACT

A voltage reference circuit (26) provides a stable output reference voltage over a wide temperature range. A high temperature curvature correction circuit (36) is enabled at a first predetermined temperature to adjust the output voltage accordingly. A low temperature curvature correction circuit (38) is enabled at temperatures below a second predetermined temperature to similarly affect a output voltage. The preferred embodiment, the high and low curvature correction circuits (36, 38) are operable to vary the current through one or more resistors in a bandgap circuit (26) or other reference circuit.

13 Claims, 3 Drawing Sheets

BANDGAP VOLTAGE REFERENCE AND METHOD WITH FURTHER TEMPERATURE CORRECTION

TECHNICAL FIELD OF THE INVENTION

This invention relates in general to integrated circuits, and more particularly to a method and apparatus for providing a stable reference voltage.

BACKGROUND OF THE INVENTION

Many integrated circuits require a stable reference voltage for their operation. For example, voltage references are used in data acquisition systems, voltage regulators and measurement equipment. Two types of voltage references are commonly used in such integrated circuits: bandgap-voltage references and buried-Zener references.

Bandgap-voltage references provide several advantages over buried-Zener references. Bandgap voltage references can operate with a lower supply voltage than buried-Zener references and also dissipate less power. Further, long-term stability of a bandgap voltage reference exceeds that of a buried-Zener reference.

Unfortunately, the output voltage of a bandgap voltage reference is more dependent upon temperature than is a buried-Zener reference. This factor becomes important if the integrated circuit is to be subjected to a wide range of temperatures, for example, if it is used outdoors. It should be noted that both bandgap-voltage references and buried-Zener references provide output voltages which are temperature-dependent to some degree.

Therefore, a need has arisen in the industry to provide a reference voltage source which provides a stable output voltage over a wide temperature range.

SUMMARY OF THE INVENTION

In accordance with the present invention, a circuit for generating a stable reference voltage is provided which substantially eliminates problems associated with prior reference voltage circuits.

The reference voltage circuit of the present invention comprises a voltage generator, such as a bandgap voltage reference or a Zener reference, which is known to provide a relatively stable voltage within a known temperature range, i.e., between $T_0$ and $T_1$. Adjusting circuitry corrects the voltage inaccuracies at temperature above $T_1$ or below $T_0$, or both extremes.

In a first embodiment of the present invention, a circuit generates a first voltage responsive to the ambient temperature. In response to the first voltage, a current is generated which affects the voltage at the output node in order to maintain a stable reference voltage.

In a second embodiment of the present invention, the reference output voltage is determined in part by a temperature dependent voltage across one or more load devices. The temperature dependent voltage is used to detect the ambient temperature, and when the temperature is determined to exceed the temperature range bounded by $T_0$ and $T_1$, the output voltage is adjusted accordingly.

The present invention provides several advantages over the prior art. First, a stable output reference voltage may be maintained over a wide temperature range. Second, the corrective circuitry requires relatively few components for reliable temperature correction.

BRIEF DESCRIPTION OF THE DRAWINGS

For a more complete understanding of the present invention and the advantages thereof, reference is now made to the following descriptions taken in conjunction with the accompanying drawings, in which.

DETAILED DESCRIPTION OF THE INVENTION

The preferred embodiment of the present invention is best understood by referring to FIGS. 1–4 of the drawings, like numerals being used for like and corresponding parts of the various drawings.

Figure 1:
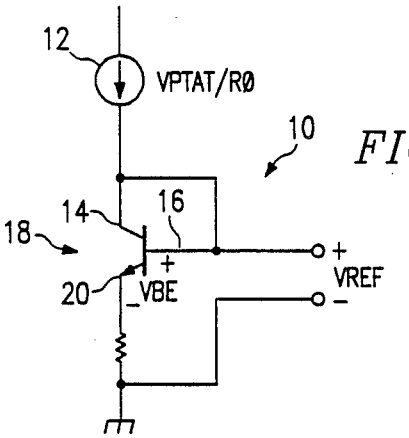
FIG. 1 illustrates a schematic representation of a prior art bandgap voltage reference.

FIG. 1 illustrates a schematic representation of a prior art bandgap voltage reference circuit. The circuit 10 comprises a reference current source 12 connected to the collector 14 and base 16 of the a NPN transistor 18. The emitter 20 of the NPN transistor to one end of a resistor $R_1$. The other end of the resistor $R_1$ is connected to ground. The voltage reference Vref is provided between the base 16 and ground.

The current source provides a current equal to $V_{ptat}/R_0$. $V_{ptat}$ is a voltage which is proportional to absolute temperature. The reference voltage $V_{ref}$ equals the base emitter voltage $V_{be}$ of the transistor 18 plus the voltage created by the current through $R_1$. Hence, $V_{ref}=V_{be}+V_{ptat}*(R_1/R_0)$. By selecting appropriate values for $R_1$ and $R_0$, the temperature dependence of the base emitter voltage $V_{be}$ can be compensated by the voltage drop across $R_1$.

While the circuit of FIG. 1 provides a relatively stable voltage over a moderate temperature range, second order effects will cause voltage dropoffs at very low and very high temperatures. Consequently, the circuit of FIG. 1 is inappropriate where the integrated circuit will be subjected to a wide temperature range.

Figure 2:
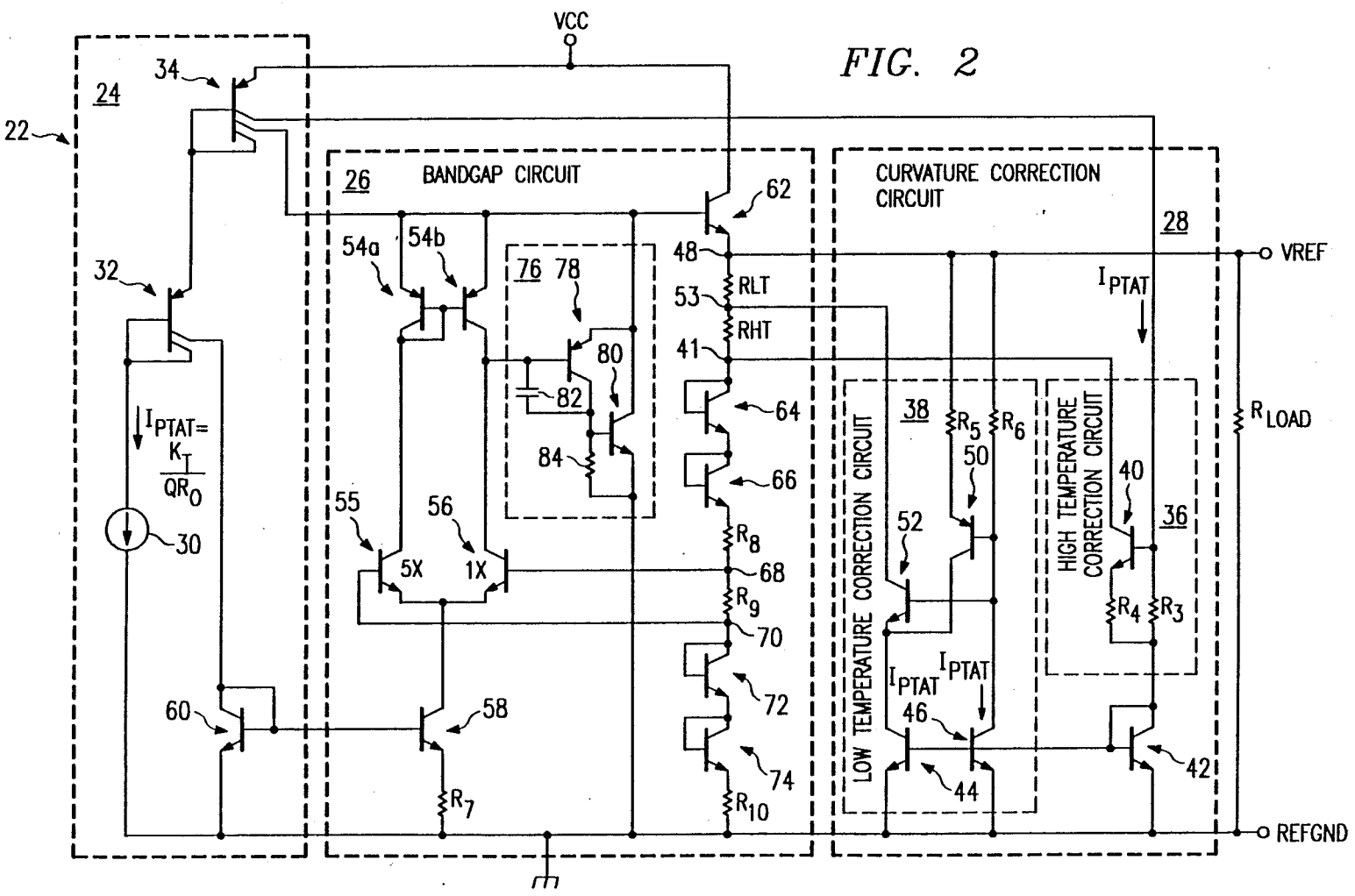
FIG. 2 illustrates the bandgap reference circuit of the present invention utilizing a circuit for compensating the nonlinearity over a wide temperature range.

FIG. 2 illustrates a schematic representation of the present invention. The curvature corrected bandgap circuit 22 comprises a reference current source section 24, a bandgap circuit section 26, and a curvature correction circuit 28.

The reference circuit section 24 generates a current $I_{ptat}$ which is relatively constant over temperature. The reference circuit section 24 is designed such that $I_{ptat}=V_{ptat}/R_0$ where $R_0$ is a resistor included in the current source 30. Both $V_{ptat}$ and $R_0$ are temperature dependent, and tend to cancel out one another, resulting in a relatively temperature independent $I_{ptat}$.

$I_{ptat}$ is mirrored through transistors 32 and 34 to supply the current $I_{ptat}$ to the curvature correction circuit 28.

The curvature correction circuit 28 comprises a high-temp compensation circuit 36 and a low-temp compensation circuit 38. The high-temp compensation circuit 36 comprises an NPN transistor 40 having its base connected to a resistor $R_3$ and to a collector of PNP transistor 34. The collector of transistor 40 is connected to a node 41 in the bandgap circuit 26. The emitter of transistor 40 is connected to a resistor $R_4$. The opposite ends of resistors $R_3$ and $R_4$ are connected to the collector of an NPN transistor 42. The emitter of collector 42 is connected to circuit common. The base of transistor 42 is connected to its collector and to the bases of NPN transistors 44 and 46. The low-temp compensation circuit 38 comprises resistors $R_5$ and $R_6$, each having one end connected to the output node 48 of the bandgap circuit 26. The opposite end of resistor $R_5$ is connected to the emitter of PNP transistor 50. The opposite end of resistor $R_6$ is connected to the collector of transistor 46, the base of transistor 50, and the base of transistor 52. The emitters of transistors 44 and 46 are connected to the circuit common. The collector of transistor 44 is connected to the collector of transistor 50 and the emitter of transistor 52. The collector of transistor 52 is connected to a node 53 in the bandgap circuit 26.

Bandgap circuit 26 comprises a current mirror including PNP transistors 54*a–b*, both having emitters connected to a collector of transistor 34. The bases of transistors 54*a–b* are connected to the collector of transistor 54*a*. The collectors of transistors 54*a–b* are connected to the collectors of NPN transistors 55 and 56, respectively. The emitters of transistors 55 and 56 are connected to the collector of NPN transistor 58. The emitter of transistor 58 is connected to the circuit common through resistor $R_7$. The base of transistor 58 is connected to the base and collector of transistor 60. The emitters of transistors 54*a–b* are also connected to the base of an NPN transistor 62. The collector of transistor 62 is connected to $V_{cc}$ and the emitter of transistor 62 is connected to node 48. Between nodes 48 and 53, a resistor $R_{LT}$ is connected. Between nodes 53 and 41, a resistor $R_{HT}$ is connected. Also connected to node 41 are the collector and base of an NPN transistor 64. The emitter of transistor 64 is connected to the collector and base of an NPN transistor 66. The emitter of transistor 66 is connected to a resistor $R_8$. The other end of resistor $R_8$ is connected to a node 68 which is connected to the base of transistor 56. The base of transistor 55 is connected to a node 70. A resistor $R_9$ is connected between nodes 68 and 70. Also connected to node 70 is the collector and base of an NPN transistor 72. The emitter of transistor 72 is connected to the collector and base of an NPN transistor 74. A resistor $R_{10}$ connects the emitter of transistor 74 with circuit common. An intermediate gain stage circuit 76 comprises a PNP transistor 78, having a emitter connected to the base of transistor 62, a base connected to the collector of transistor 54*b* and an collector connected to the base of an NPN transistor 80. A capacitor 82 is connected between the base and collector of transistor 78. The collector of transistor 80 is connected to the emitter of transistor 78. A resistor 84 is connected between the base and emitter of transistor 80. The emitter of transistor 80 is connected to the circuit common.

Notably, resistors $R_0$, $R_3$, and $R_6$ are made from the same material, such that these temperature coefficients will be substantially identical. Hence the voltages through $R_6$ will be proportional $V_{ptat}$, which is dependent upon temperature.

In operation, the circuit 26 operates similar to a typical bandgap circuit, such as one shown in FIG. 1, in a temperature range between $T_0$ and $T_1$, where the output voltage is relatively constant. In this temperature range, transistors 54*a–b* force equal currents through transistors 55 and 56. Transistors 55 and 56 have a specified emitter area ratio, shown in FIG. 2 as 5:1. Hence, a voltage $\Delta V_{be}$ develops between the bases of the transistors 55 and 56. Since the bases of transistors 55 and 56 are connected across resistor $R_9$, a current develops through resistor $R_9$ equal to $\Delta V_{be}/R_9$. Hence, the output voltage between node 48 and ground can be shown to be:

$$V_{out}=4V_{be}+(R_{tot}/R_9)\,\Delta V_{be}$$

where, $4V_{be}$=the combined base emitter voltages of transistors 64, 66, 72 and 74

$R_{tot}=R_{LT}+R_{HT}+R_8+R_9+R_{10}$, and $\Delta V_{be}=kT/q\ \ln 5$.

Gain stage circuit 76 operates to maintain an equal current through transistors 54*a–b* by loading transistor 56 insignificantly.

At temperatures greater than $T_1$, the high temperature compensation circuit 36 is enabled. As temperatures increase, the voltage drop over resistor $R_3$ similarly increases. When the voltage across $R_3$ reaches a predetermined voltage, the transistor 40 will begin to turn on, thereby drawing additional current through resistors $R_{LT}$ and $R_{HT}$. Hence, the high temperature compensation circuit 36 acts to increase the output voltage at higher temperature. As temperature increases, transistor 40 will draw more current to further increase the output voltage. Resistor $R_4$ is provided to implement a gradual change in current through transistor 40 as temperature increases.

Similarly, the low temperature compensation circuit 38 boosts the output voltage at temperatures below $T_0$. Transistors 44 and 46 mirror the current through transistor 42. Hence, transistors 44 and 46 will draw current equal to $I_{ptat}$. At low temperatures, the voltage across resistor $R_6$ will be low. Resistor $R_6$ has a value such that at temperatures below $T_0$, the PNP transistor 50 will not turn on. Hence, the current drawn by transistor 44 must be drawn through transistor 52. Since the collector of transistor 52 is connected to node 53, an additional voltage is drawn through resistor $R_{LT}$, thereby increasing the output voltage $V_{out}$. As temperature increases, the voltage across $R_6$ will increase causing PNP transistor 50 to conduct. As transistor 50 conducts, the current through transistor 52 will decrease, reducing the voltage drop across $R_{LT}$.

The temperatures at which the curvature correction circuit affects the output voltage may be varied by adjusting resistors $R_6$ and $R_3$, along with resistor $R_0$. Hence, the curvature correction circuit 28 is operable to provide curvature correction at any two temperatures. Further, additional circuits similar to the high temperature compensation circuit 36 and low temperature compensation circuit 38 may be used to provide further curvature correction.

Figure 3:
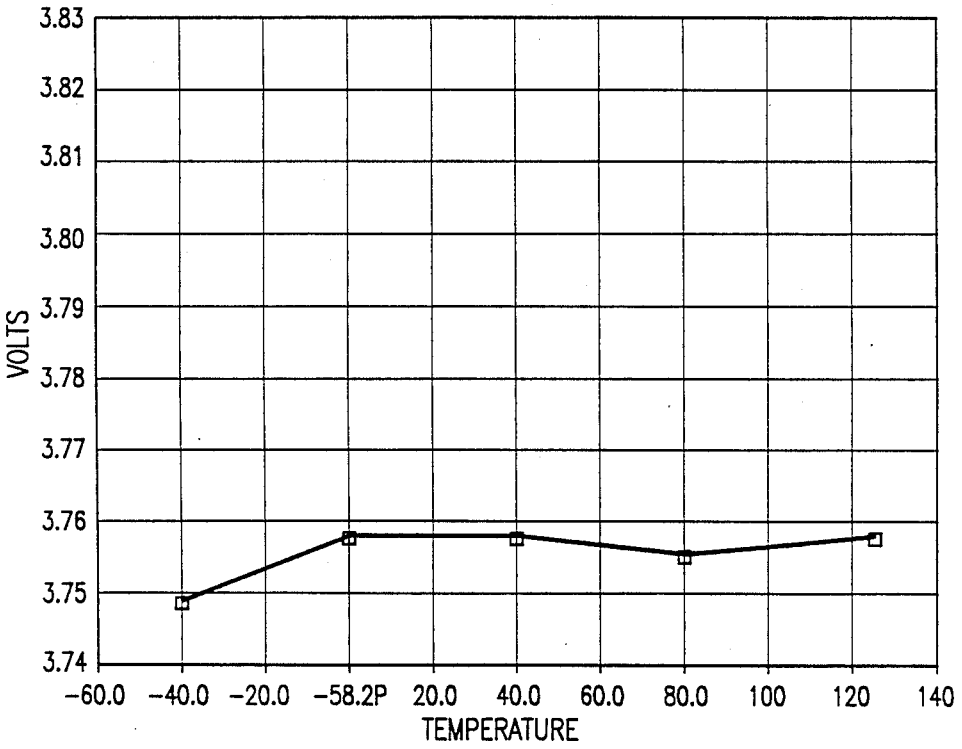
FIG. 3 illustrates a second embodiment of the present invention.

FIG. 3 illustrates a second embodiment of the present invention wherein the high temperature correction circuit is driven by the bandgap voltage circuit, without the need for a separate reference current section 24. The bandgap circuit 26 is essentially the same as shown in FIG. 3. However, the high temperature compensation circuit 36 comprises a transistor 86 having a base connected to the emitter of transistor 74. The collector of the transistor 86 is connected to node 53 and the emitter of transistor 86 is connected to circuit common through resistor $R_{1l}$. It should be noted that $R_{LT}$ is not present in this embodiment of the invention since only the high temperature compensation circuit 36 is present. However, it would possible to provide a low temperature compensation circuit as shown in FIG. 2 in the embodiment of FIG. 3.

As previously discussed, at a certain temperature $T_1$, the output voltage $V_{out}$ will decrease due to diode drops of transistors 64, 66, 72 and 74 decreasing faster than the voltage across the resistors $R_8$, $R_9$, and $R_{10}$ is increasing. The voltage across $R_{10}$ will increase as temperature increases. $R_{10}$ may be provided a value such that at temperature $T_1$, the transistor 86 is enabled. When transistor 86 is enabled, additional current will be drawn through $R_{HT}$, thereby increasing the output voltage. Resistor $R_{10}$ may be adjusted to enable the transistor 86 at a desired temperature. Resistor $R_{1l}$ is provided to gradually increase the current through transistor 86 with temperature.

Figure 4:
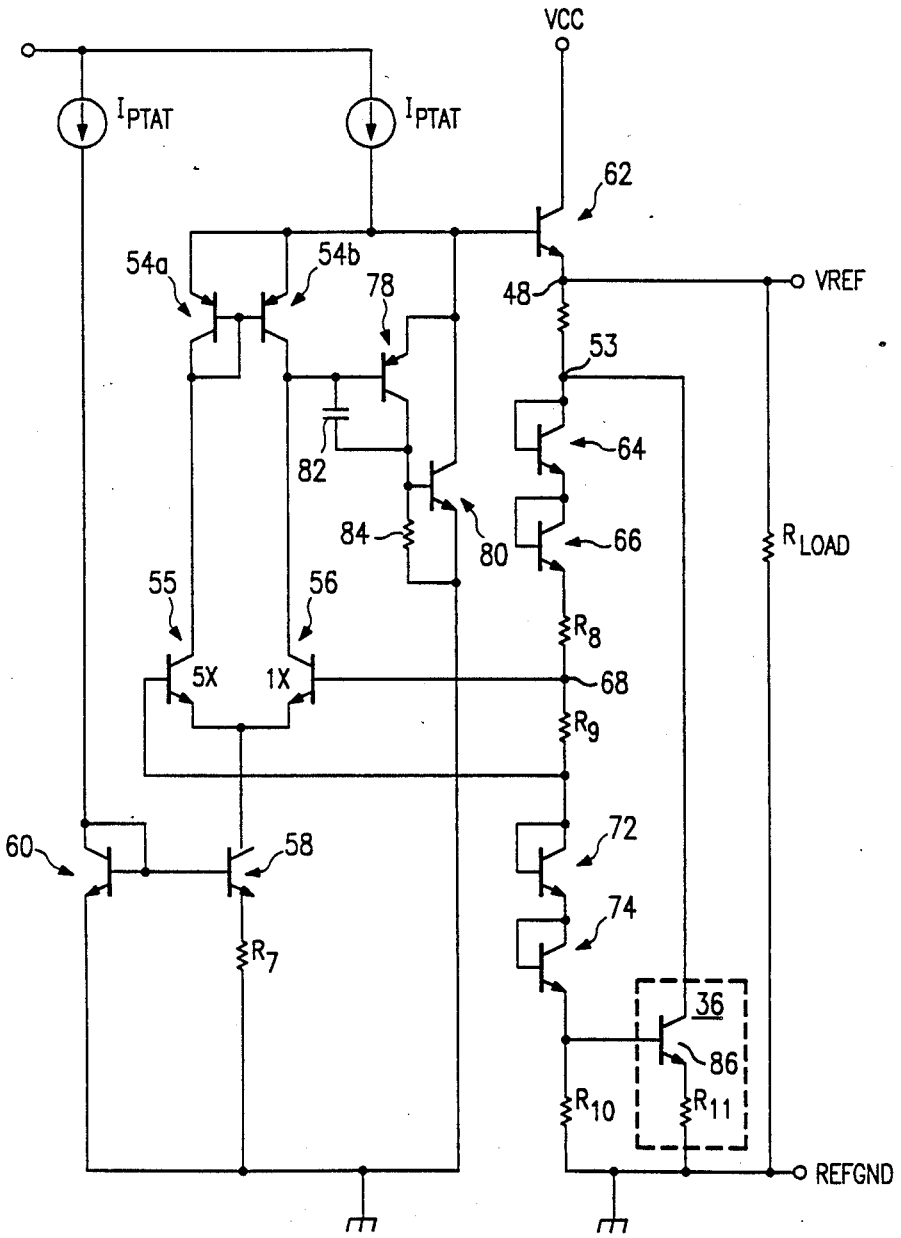
FIG. 4 illustrates a graph depicting the output of the bandgap voltage reference of the present invention.

FIG. 4 illustrates a graph depicting the output voltage of the bandgap circuit 22 of FIG. 3 having high temperature curvature correction. As can be seen, the output voltage is relatively stable within ten millivolts over a temperature range from −40° F. to 120° F.

The present invention provides the technical advantage that additional compensation may be enabled at high and low temperatures in order to provide a more constant reference voltage over a wide temperature range. The temperature at which the additional compensation is provided may be varied by adjusting the values of one or more resistors. The circuit of the present invention requires minimal additional hardware to accomplish the compensation.

Although the present invention has been described in detail, it should be understood that various changes, substitutions and alterations can be made herein without departing from the spirit and scope of the invention as defined by the appended claims.

What is claimed is:

1. A circuit for generating a stable reference voltage over a wide temperature range, comprising:

a voltage generator for providing a relatively stable output voltage within a known temperature range, said generator including (i) first and second mismatched bipolar transistors, the emitters of said first and second bipolar transistors tied together, (ii) a first resistor connected between the bases of said first and second bipolar transistors, and (iii) a second resistor in series with said first resistor and passing said first current, said generator providing said relatively stable output voltage from current determined by said first resistor; and circuitry for adjusting said output voltage responsive to a predetermined temperature to maintain a stable output voltage, said circuitry providing current at through said second resistor and parallel said first resistor for temperatures outside of said known temperature range.

2. The circuit of claim 1 wherein said voltage generator comprises a bandgap voltage reference.

3. The circuit of claim 1 wherein said adjusting circuitry comprises:

a circuit for generating a temperature dependent voltage; and a circuit for generating a current responsive to said temperature dependent voltage.

4. The circuit of claim 3 wherein said circuit for generating a voltage comprises a resistor.

5. The circuit of claim 3 wherein said circuit for generating a current comprises a transistor.

6. The circuit of claim 1 wherein said voltage generator includes one or more resistors through which a current is driven.

7. The circuit of claim 6 wherein said adjusting circuitry comprises circuitry to adjust the current through one or more of said resistors such that the voltage across the resistors is varied.

8. The circuit of claim 1 wherein said adjusting circuitry comprises first adjusting circuitry to adjust the output voltage in response to a first temperature and second adjusting circuitry to adjust the output voltage in response to a second temperature.

9. The method of generating a stable output voltage reference comprising the steps of:

generating a relatively stable output voltage over a known temperature range by the use of emitter tied mismatched bipolar transistors with bases connected by a first resistor and with said relatively stable output voltage determined by a first current through said first resistor;

detecting a predetermined temperature; and adjusting said output voltage in response to said temperature detection in order to provide a stable voltage reference by drawing a second current through a second resistor, said second resistor in series with said first resistor and said second resistor passing said first current.

10. The method of claim 9 wherein said detection step comprises:

generating a temperature dependent voltage; and detecting a predetermined voltage level.

11. The method of claim 10 wherein said adjusting step comprises the step of enabling a transistor responsive to detecting said predetermined voltage level.

12. The method of claim 11 wherein said step of generating a relatively stable output voltage comprises the step of drawing current through one or more resistors.

13. The method of claim 12 wherein said adjusting step further comprises the step of adjusting the amount of current through one or more of said resistors.

* * * * *

UNITED STATES PATENT AND TRADEMARK OFFICE

CERTIFICATE OF CORRECTION

PATENT NO. : 4,939,442 
DATED : July 3, 1990
INVENTOR(S) : Fernando D. Carvajal and Thomas A. Schmidt It is certified that error appears in the above-identified patent and that said Letters Patent is hereby corrected as shown below:

Column 5,
Line 49, replace "said first current" with -- a first current --.
Lines 54 and 55, replace "providing current at through said second resistor and parallel said first resistor" with -- providing current through said second resistor and parallel to said first resistor --.

Signed and Sealed this

Eighth Day of October, 2002

*Attest:*

*Attesting Officer*

JAMES E. ROGAN
*Director of the United States Patent and Trademark Office*